US010926424B2

(12) United States Patent
Scimone et al.

(10) Patent No.: US 10,926,424 B2
(45) Date of Patent: Feb. 23, 2021

(54) CUTTING DEVICE

(71) Applicant: Slice, Inc., San Jose, CA (US)

(72) Inventors: Thomas Scimone, Campbell, CA (US); Scot Herbst, Santa Cruz, CA (US); Robert Joseph Gallegos, Fremont, CA (US); Fu Keung Ng, Kowloon (HK)

(73) Assignee: Slice, Inc., San Jose, CA (US)

( * ) Notice: Subject to any disclaimer, the term of this patent is extended or adjusted under 35 U.S.C. 154(b) by 0 days.

(21) Appl. No.: 16/379,999

(22) Filed: Apr. 10, 2019

(65) Prior Publication Data

US 2019/0240850 A1 Aug. 8, 2019

Related U.S. Application Data

(63) Continuation-in-part of application No. 15/850,568, filed on Dec. 21, 2017, now Pat. No. 10,279,491, which is a continuation-in-part of application No. 15/435,757, filed on Feb. 17, 2017, now Pat. No. 9,925,674, which is a continuation of application No. 14/106,678, filed on Dec. 13, 2013, now Pat. No. 9,579,808.

(60) Provisional application No. 61/739,712, filed on Dec. 19, 2012.

(51) Int. Cl.

| | |
|---|---|
| ***B26B 5/00*** | (2006.01) |
| ***B26B 1/00*** | (2006.01) |
| ***B26B 1/10*** | (2006.01) |
| *B26B 1/08* | (2006.01) |

(52) U.S. Cl.

CPC ..... *B26B 5/003* (2013.01); *B26B 1/00* (2013.01); *B26B 1/10* (2013.01); *B26B 5/001* (2013.01); *B26B 1/08* (2013.01)

(58) Field of Classification Search

CPC ..... B26B 5/003; B26B 5/001; B26B 1/00; B26B 1/10; B26B 1/08

See application file for complete search history.

(56) References Cited

U.S. PATENT DOCUMENTS 6,006,433 A * 12/1999 Baltazar ..... B26B 5/001 30/152
6,848,185 B2 * 2/2005 Tebo ..... B26B 9/02 30/125
7,185,435 B1 * 3/2007 Tseng ..... B26B 5/001 30/152
9,174,347 B2 * 11/2015 Hongquan ..... B26B 1/08
(Continued)

*Primary Examiner* — Omar Flores Sanchez
(74) *Attorney, Agent, or Firm* — Ellenoff Grossman & Schole LLP; James M. Smedley; Alex Korona

(57) ABSTRACT

A cutting device is disclosed. The cutting device has a first housing member, a second housing member that is removably attachable to the first housing member to form a housing, and a carriage that is movably disposed in the housing, the carriage including a first attachment portion, which is disposed at a first portion of the carriage, and a second attachment portion, which is disposed at a second portion of the carriage that is disposed away from the first portion of the carriage. The cutting device also has an exterior member disposed at an exterior of the housing and attached to the carriage via an aperture disposed in one of the first housing member and the second housing member, and a cutting member that is removably attachable to the first attachment portion at the first portion of the carriage.

22 Claims, 10 Drawing Sheets

(56) References Cited

U.S. PATENT DOCUMENTS

| | | | | |
|---|---|---|---|---|
| 9,226,636 | B2 * | 1/2016 | Landwehr | A47L 13/08 |
| 2018/0029240 | A1 * | 2/2018 | Douglass | B26B 25/007 |
| 2018/0194021 | A1 * | 7/2018 | Nguyen | B26B 11/008 |
| 2020/0108515 | A1 * | 4/2020 | Scimone | B26B 5/003 |
| 2020/0122346 | A1 * | 4/2020 | Vreeland | B26B 5/003 |

* cited by examiner

CUTTING DEVICE

CROSS-REFERENCE TO RELATED APPLICATIONS

This application is a continuation-in-part of U.S. patent application Ser. No. 15/850,568 filed on Dec. 21, 2017, which is a continuation-in-part of U.S. patent application Ser. No. 15/435,757 filed on Feb. 17, 2017, which is a continuation of U.S. patent application Ser. No. 14/106,678 filed on Dec. 13, 2013, which issued as U.S. Pat. No. 9,579,808 on Feb. 28, 2017, which claims the benefit of U.S. patent application Ser. No. 61/739,712 filed on Dec. 19, 2012, each of which is hereby incorporated by reference in its entirety.

TECHNICAL FIELD

The present disclosure generally relates to a cutting device, and more particularly to a cutting device having one or more replaceable blades.

BACKGROUND

The pocket cutter is a basic cutting tool that may be provided in a variety of forms. As the name suggests, a typical pocket cutter is small enough to be carried in the pocket of a user. Additionally, the typical pocket cutter is a compact cutting tool with a folding or otherwise retractable blade. The typical pocket cutter involves a user unfolding a blade from a handle or extending the blade with a button or other mechanism in order to lock the blade into place before using the blade. This design feature creates an increased chance of injury, as the blade is left exposed for extended periods of time because many users find it cumbersome and time consuming to securely retract the blade when the pocket cutter is used repeatedly in a short time span.

Current pocket cutters also pose a safety concern in how a user holds the tool. The ergonomics of a standard pocket cutter require a user to wrap their hand completely around the handle of the pocket cutter. This design creates a hazard to the user as the handle can slip through the user's hand and expose the user to the blade of the pocket cutter as the pocket cutter passes through the user's hand. This shortcoming is exacerbated by the fact that the blade of the pocket cutter blade remains extended as it does not automatically retract.

Current pocket cutters also pose a challenge to some users based on whether the user is left-handed or right-handed. Current pocket cutters are typically designed for one type of user (e.g., right-handed users), which causes difficulties for use of the pocket cutter by other users (e.g., left-handed users).

The exemplary disclosed cutting device and method of the present disclosure is directed to overcoming one or more of the shortcomings set forth above and/or other deficiencies in existing technology.

SUMMARY OF THE DISCLOSURE

In one exemplary aspect, the present disclosure is directed to a cutting device. The cutting device includes a first housing member, a second housing member that is removably attachable to the first housing member to form a housing, and a carriage that is movably disposed in the housing, the carriage including a first attachment portion, which is disposed at a first portion of the carriage, and a second attachment portion, which is disposed at a second portion of the carriage that is disposed away from the first portion of the carriage. The cutting device also includes an exterior member disposed at an exterior of the housing and attached to the carriage via an aperture disposed in one of the first housing member and the second housing member, and a cutting member that is removably attachable to the first attachment portion at the first portion of the carriage. The cutting member is removably attachable to the second attachment portion at the second portion of the carriage. The carriage includes a protrusion. The aperture includes a first aperture portion and a second aperture portion. The protrusion is selectively receivable in the first aperture portion and in the second aperture portion.

In another aspect, the present disclosure is directed to a method. The method includes removably attaching a first housing member to a second housing member to form a housing, at least one of the first housing member and the second housing member including an aperture having a first aperture portion and a second aperture portion, movably disposing a carriage in the housing, the carriage including a protrusion, and removably attaching a cutting member to a first attachment portion disposed at a first half of the carriage. The method also includes removably attaching the cutting member to a second attachment portion disposed at a second half of the carriage, and selectively receiving the protrusion in the first aperture portion and in the second aperture portion.

DETAILED DESCRIPTION AND INDUSTRIAL APPLICABILITY

Figure 1:
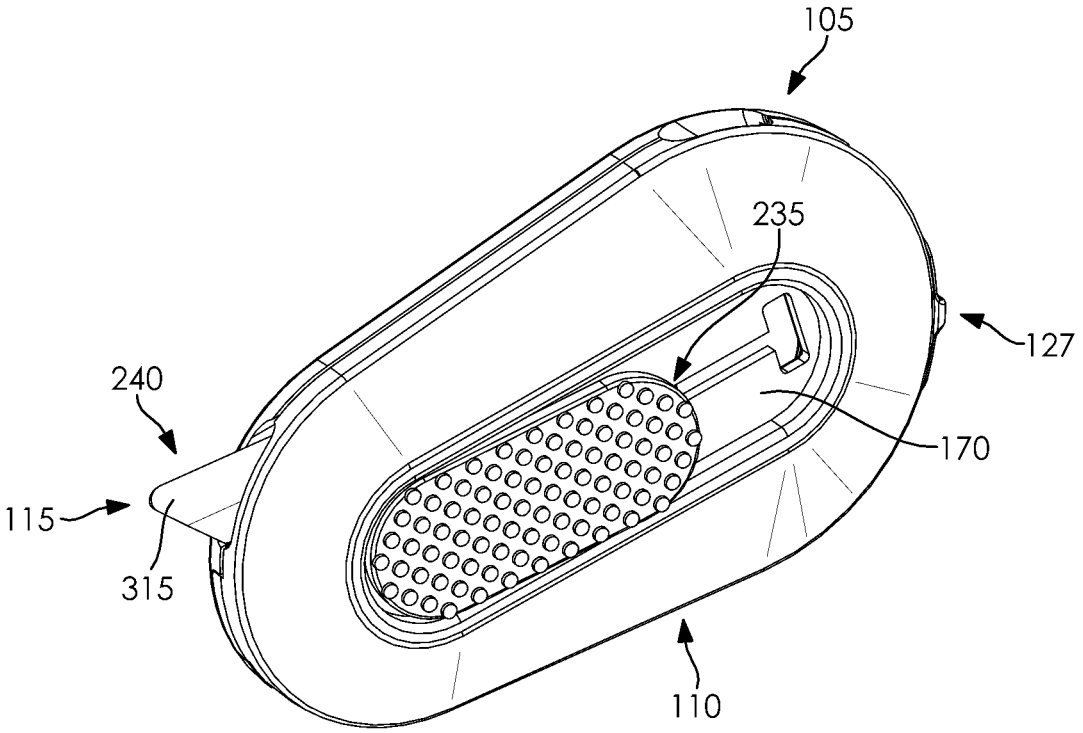
FIG. 1 is a perspective view of an exemplary cutting device in accordance with an embodiment of the present invention.
Figure 2:
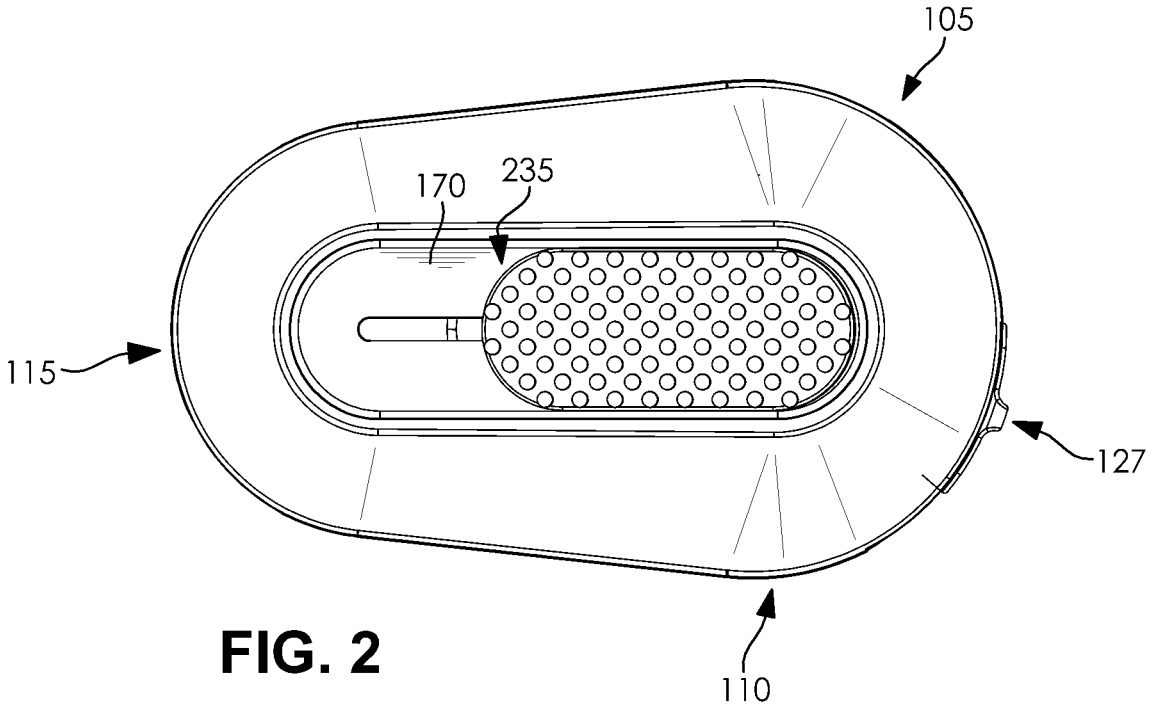
FIG. 2 is a side view of an exemplary cutting device in accordance with an embodiment of the present invention.
Figure 3:
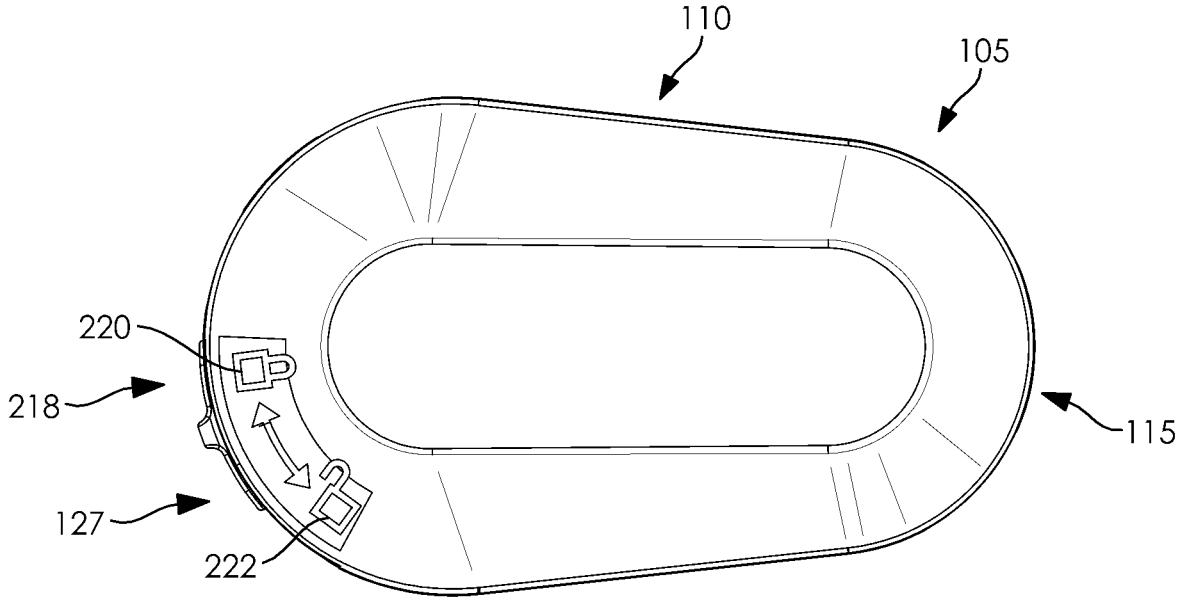
FIG. 3 is a side view of an exemplary cutting device in accordance with an embodiment of the present invention.

FIG. 1 illustrates an exemplary cutting device 105. FIG. 2 illustrates a first side (e.g., front side) of cutting device 105 and FIG. 3 illustrates a second (e.g., reverse side) of cutting device 105. The exemplary cutting device disclosed herein may be any suitable device for cutting material such as, for example, a pocket cutter, a seam ripper, a box cutter, a utility knife, or a precision knife. For example, cutting device 105 may be a pocket cutter or similar cutting device.

Cutting device 105 may include a housing 110 and a cutting assembly 115. Cutting assembly 115 may be movably disposed in housing 110. The exemplary cutting device may be constructed from any suitable variety of durable materials. For example, some or most of the components of the exemplary cutting device may be formed from plastic or a plastic composite material. Also for example, some or most of the components of the exemplary cutting device may be formed from metal or metal alloy. Further for example, the exemplary cutting device may include ceramic material. For example, cutting device 105 may be formed from plastic, plastic composite, metal, metal alloy, and/or ceramic materials. For example, cutting device 105 may be formed from a variety of materials disclosed herein. For example, housing 110 may be formed partially or substantially entirely from plastic, plastic composite, metal, and/or metal alloy materials. For example, housing 110 may be formed from plastic or metal structural members. A magnet included in housing 110, described further below, may be formed for example from metal material or other material that may have magnetic properties. As described further below, cutting assembly 115 may include components formed from plastic, plastic composite, metal, and/or metal alloy materials and components formed from ceramic materials. Also for example, certain components of cutting device 105 may include specific materials based upon the application or function of a given component. For example, members of cutting device 105 designed to come into contact with a cutting surface and that may be subject to constant friction may include materials resistant to friction such as glass-filled nylon and/or polyamide plastic. For example, cutting device 105 may include any suitable materials for use in a cutting device such as, e.g., a pocket cutter, a seam ripper, a box cutter, a utility knife, or a precision knife.

Housing 110 may provide, for example, a handle for cutting device 105 for use by a user. For example, housing 110 may provide a pocket cutter handle, a seam ripper handle, or a handle of a box cutter, utility knife, or precision knife. For example, housing 110 may be a substantially hollow housing configured to receive and retain cutting assembly 115 as well as additional components such as the exemplary components described herein. For example, housing 110 may be an elliptical-shaped, disc-shaped, and/or cylindrical housing. For example, housing 110 may be flat and substantially oval in shape. Also for example, housing 110 may be any other suitable shape such as, for example, a substantially regular tube shape, e.g., a square, triangular, hexagonal, and/or octagonal shape.

Figure 4:
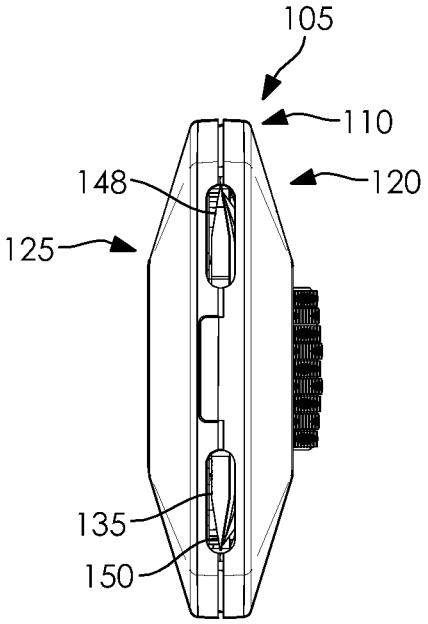
FIG. 4 is a front view of an exemplary cutting device in accordance with an embodiment of the present invention.
Figure 5:
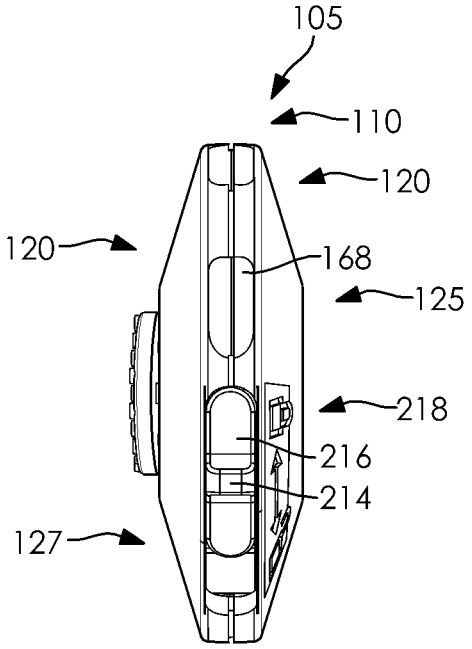
FIG. 5 is a rear view of an exemplary cutting device in accordance with an embodiment of the present invention.

As illustrated in FIGS. 4 and 5, housing 110 may include a housing member 120, a housing member 125, and a locking assembly 127. Housing members 120 and 125 may be, for example, corresponding halves of housing 110 that may be attached together to form housing 110. For example, housing member 120 may be a front member such as, for example, a front-half body shell, and housing member 125 may be a rear member such as, for example, a rear-half body shell. Housing members 120 and 125 may be configured to house or contain (e.g., separately or working together to house or contain) other components of cutting device 105. Locking assembly 127 may serve to lock housing members 120 and 125 together.

Figure 6:
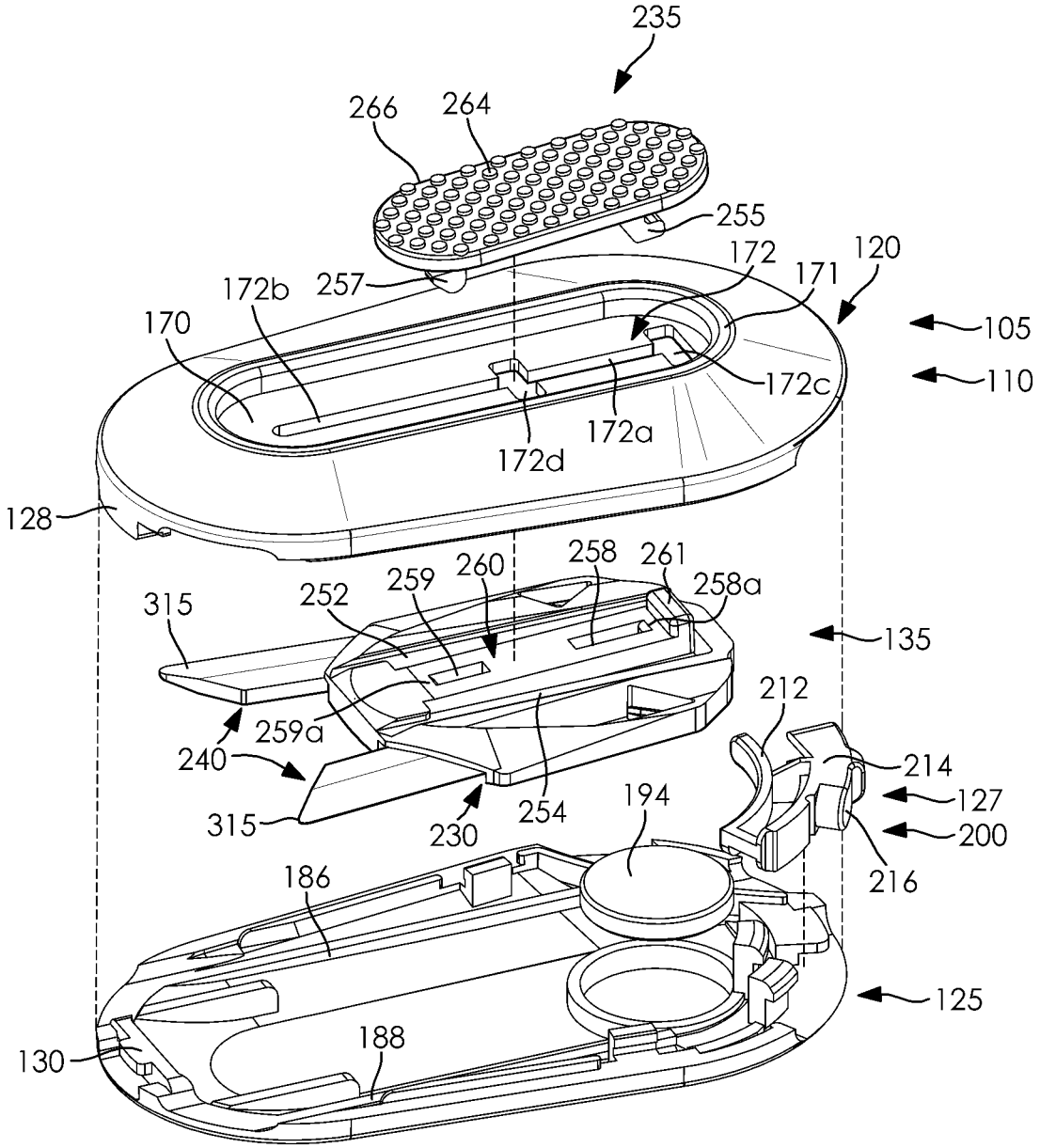
FIG. 6 is an exploded view of an exemplary cutting device in accordance with an embodiment of the present invention.
Figure 7:
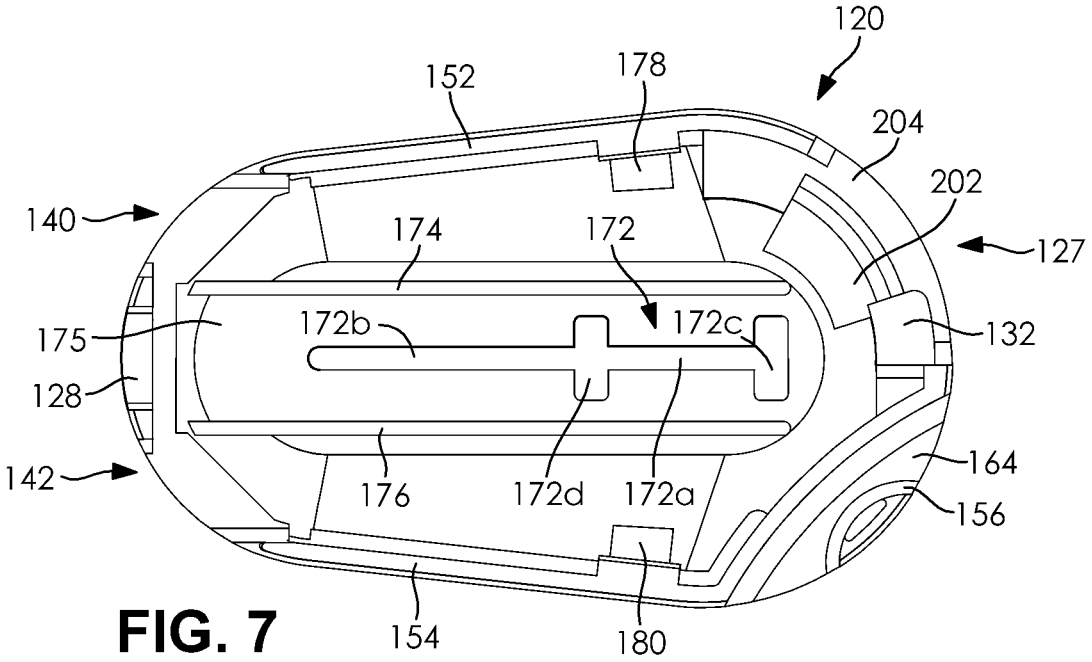
FIG. 7 is a top view of a portion of an exemplary cutting device in accordance with an embodiment of the present invention.
Figure 8:
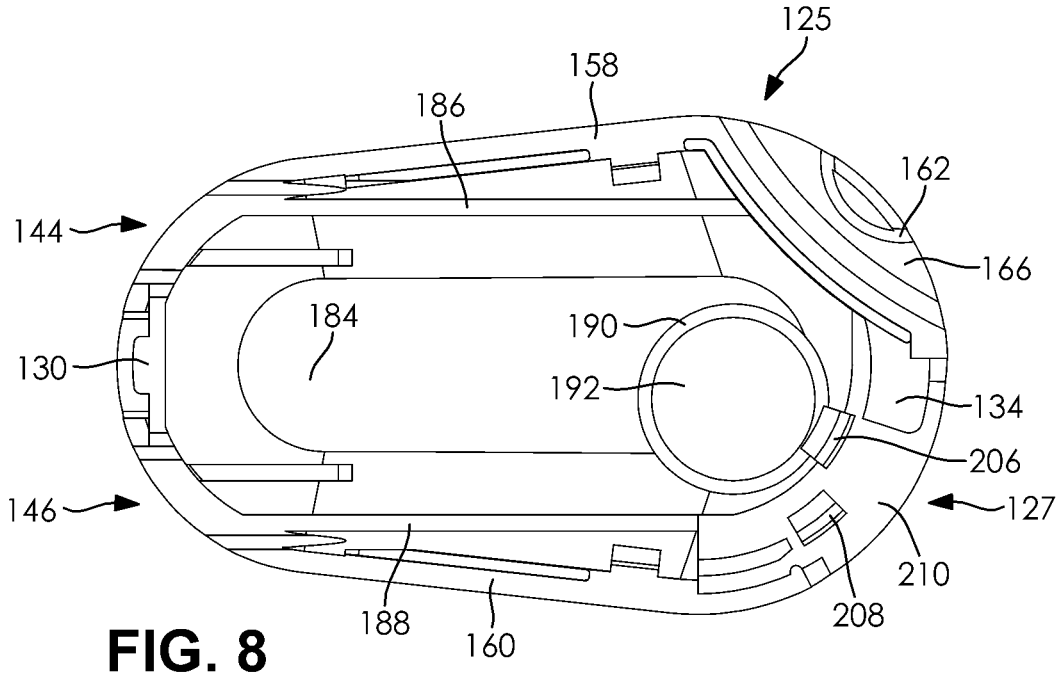
FIG. 8 is a top view of a portion of an exemplary cutting device in accordance with an embodiment of the present invention.

As illustrated in FIGS. 6-8, housing members 120 and 125 may include a plurality of engagement elements to facilitate removable attachment of housing members 120 and 125. For example, housing member 120 may include a connector element 128 and housing member 125 may include a connector element 130. Both connector elements 128 and 130 may be located at a front portion of housing 110, and may be configured to connect and align a front portion of main body housing 110 during an attachment of housing members 120 and 125. For example, connector elements 128 and 130 may be configured to connect housing member 120 (e.g., a front-half body shell) to housing member 125 (e.g., a rear-half body shell) for example, in addition to or instead of locking assembly 127. Also for example, housing member 120 may include a connector element 132 and housing member 125 may include a connector element 134. Both connector elements 132 and 134 may be located at a rear portion of housing 110, and may be configured to connect and align a rear portion of main body housing 110 during an attachment of housing members 120 and 125. For example, connector elements 132 and 134 may be configured to connect housing member 120 (e.g., a front-half body shell) to housing member 125 (e.g., a rear-half body shell), e.g., in addition to or instead of locking assembly 127. Housing members 120 and 125 may form a cavity 135 (e.g., channel) disposed within housing 110.

It is also contemplated that housing 110 may include integral portions that are not removably attachable (e.g., housing 110 may be formed by a single integral housing member having portions 120 and 125 that may be integral portions of housing 110). In this exemplary embodiment, for example, the one or more exemplary cutting members described herein may be replaced by extending the cutting member though the exemplary housing apertures described herein. Also, for example, engagement (e.g., connection and/or alignment) between the various components of housing 110 may be provided by using any type of suitable design.

Housing members 120 and 125 may include a plurality of apertures disposed at a front portion of housing 110 to receive the exemplary cutting members described herein. For example, housing member 120 may include an aperture 140 and an aperture 142, and housing member 125 may include an aperture 144 and an aperture 146. Apertures 140, 142, 144, and 146 may be located at a front portion of housing 110, and may be configured to form apertures in housing 110 to receive exemplary cutting members. For example, apertures 142 and 144 may be aligned to form an aperture 148 in housing 110 as illustrated in FIG. 4. Also for example, apertures 140 and 146 may be aligned to form an aperture 150 in housing 110 as illustrated in FIG. 4. For example, apertures 148 and 150 may be blade outlet slots formed in housing 110.

Housing members 120 and 125 may also include a plurality of wall portions and apertures for forming side walls of housing 110 and an attachment point to facilitate carrying and/or storage. For example, housing 120 may include portions 152 and 154 (e.g., side portions) and a portion 156 (e.g., a rear portion). Also for example, housing 125 may include portions 158 and 160 (e.g., side portions) and a portion 162 (e.g., a rear portion). When housing members 120 and 125 are attached (e.g., removably attached), portion 152 may align with portion 160 to form a first side wall portion of housing 110, and portion 154 may align with portion 158 to form a second side wall portion of housing 110. Also, for example, when housing members 120 and 125 are attached (e.g., removably attached), portions 156 and 162 may align to form an attachment portion of housing 110. For example, when housing members 120 and 125 are attached (e.g., removably attached), an aperture 164 formed between portion 156 and other portions of housing member 120 such as portion 154, and an aperture 166 formed between portion 162 and other portions of housing member 125 such as portion 158, may be aligned to form aperture 168 as illustrated in FIG. 5. Aperture 168 may be utilized by a user of cutting device 105 as an attachment portion for example for storing or carrying cutting device 105. For example, aperture 168 may be a lanyard attachment point.

As illustrated in FIG. 6, housing member 120 may include a recess 170 formed by a portion 171 (e.g., exterior wall portion) at an outer surface of housing member 120. For example, recess 170 may be configured to receive an exemplary portion of cutting assembly 115 disclosed herein. Recess 170 may include an aperture 172. Aperture 172 may be an elongated aperture (e.g., a groove) for receiving a portion of cutting assembly 115 that may be disposed in recess 170. Aperture 172 may extend substantially entirely through housing member 120, creating a passage from an exterior surface of housing member 120 to a cavity 135 (e.g., an interior cavity or a channel) of housing 110. For example, recess 170 may be a depression formed in an outer surface portion of housing member 120, and aperture 172 may be an opening in the outer surface portion of housing member 120 that may be substantially contained within recess 170. For example, aperture 172 may define limits of movement of cutting assembly 115 based on a length of aperture 172. Aperture 172 may include a portion 172*a*, a portion 172*b*, a portion 172*c*, and a portion 172*d*. Portions 172*a* and 172*b* may be for example longitudinal portions (e.g., grooves) that extend in a longitudinal direction of cutting device 105. Portions 172*c* and 172*d* may extend in a direction that is different from portions 172*a* and 172*b*. For example, portions 172*c* and 172*d* may extend in a direction that is substantially perpendicular to portions 172*a* and 172*b*. For example, portions 172*a* and 172*b* may extend in a transverse direction of cutting device 105. It is also contemplated that portions 172*a*, 172*b*, 172*c*, and/or 172*d* may extend in any direction along recess 170.

As illustrated in FIG. 7, housing member 120 may also include a plurality of portions disposed on an interior surface 175 (e.g., a surface of housing member 120 facing interior cavity 135 of cutting device 105) that may serve as a track or guide to direct a movement of cutting assembly 115 and to substantially block or stop a movement of cutting assembly 115. For example, housing member 120 may include portions 174 and 176 that may be elongated portions extending in a longitudinal direction of cutting device 105. For example, portions 174 and 176 may form a set of ribs and/or channels disposed on surface 175. For example, portions 174 and 176 and surface 175 may provide a guide assembly that interconnects with portions of cutting assembly 115 to provide a track for a movement of cutting assembly 115. For example, portions 174 and 176 may guide and/or provide a non-rotational movement or displacement of cutting assembly 115 between a retracted position and an extended position.

Also for example as illustrated in FIG. 7, housing member 120 may include one or more portions (e.g., portions 178 and 180) that may also be disposed on interior surface 175. Housing member 120 may for example include protrusions that may serve to substantially block or stop a movement of cutting assembly 115, thereby defining a movement range of cutting assembly 115 within cavity 135 of housing 110. Such portions for example may be disposed at a rear portion and/or a middle rearward or middle portion (e.g., a portion disposed at a rear half of housing member 120) of housing member 120. For example, such portions may define a rear boundary of movement (e.g., a retracted position or rear position) of cutting assembly 115 within cutting device 105. Also for example, housing member 120 may include a plurality of portions 178 and 180 that may be snap-fit portions that snap-fit with corresponding portions of housing member 125 to snap-fit housing members 120 and 125 together.

As illustrated in FIG. 8, housing member 125 may include an interior surface 184 (e.g., a surface of housing member 125 facing interior cavity 135 of cutting device 105) that may face surface 175 of housing member 120. Surface 184 may be shaped to guide a movement of cutting assembly 115 within cavity 135. Housing member 125 may also include a plurality of portions 186 and 188 that may serve as a track or guide to direct a movement of cutting assembly 115.

Housing member 125 may also include a portion 190 that may protrude from surface 184. For example, portion 190 may be an elongated wall portion that may form a recess 192. Recess 192 may be a receptacle that may receive a magnetic component 194. Magnetic component 194 may be secured within recess 192 by any suitable technique (e.g., adhesive attachment to a surface of recess 192 and/or a mechanical attachment to portion 190 and/or a surface portion of recess 192). Magnetic component 194 may be formed from any suitable magnetic material such as, for example, magnetized material such as magnetized iron, magnetized cobalt, rare-earth alloys, magnetized nickel, naturally occurring materials with magnetic properties, and/or any suitable ferromagnetic material. Magnetic component 194 may also be formed from any suitable material that is attracted to a magnet such as, for example, cobalt, iron, nickel, and/or any other suitable material. Magnetic component 194 may be useful for any variety of tasks such as, for example, holding or securing replacement blades, securing or storing cutting device 105 on a magnetic and/or metallic surface, and/or picking up small objects such as nails, screws, or other intricate objects.

Locking assembly 127 of housing 110 may include locking member 200 and portions of housing members 120 and/or 125. Locking assembly 127 may serve to lock (e.g., selectively lock) housing members 120 and 125 together.

As illustrated in FIG. 7, locking assembly 127 may include a portion 202 that may protrude from an interior surface 204 of housing member 120. As illustrated in FIG. 8, locking assembly 127 may also include a portion 206 and a portion 208 that may protrude from an interior surface 210 of housing member 125. Locking member 200 may be removably disposable on housing member 125. For example, when housing members 120 and 125 are detached, locking member 200 may be movably attached to housing member 125. For example, when a user detaches housing members 120 and 125, locking member 200 may remain for example attached to housing member 125. For example, a portion 212 of locking member 200 may be disposed between portions 206 and 208. Portion 212 may move between a gap provided between portions 206 and 208, thereby allowing locking member 200 for example to be movably disposed on housing member 125. It is also contemplated that locking member 200 may alternatively remain attached to housing member 120 when housing members 120 and 125 are detached. It is also contemplated that in an exemplary embodiment in which housing 110 is an integral housing (e.g., when housing 110 may be formed by a single integral housing member having portions 120 and 125 that may be integral portions of housing 110), locking member 200 may remain movably attachable to both portions 120 and 125 of housing 110 (or, e.g., may be omitted).

As illustrated in FIGS. 5-8, when housing members 120 and 125 are attached, locking member 200 may be movably disposed along a plurality of apertures (e.g., a track or a guide) formed between portion 202 and surface 204 of housing member 120 and portions 206 and 208 and surface 210 of housing member 125. For example, portion 202 and/or surface 204 of housing member 120 and portions 206 and/or 208 and/or surface 210 of housing member 125 may be in contact with (e.g., and interconnect with) portion 212 of locking member 200 so that a movement of locking member 200 is guided within housing 110. For example, portion 202 of housing member 120 and portions 206 and 208 of housing member 125 may define a range of movement of locking member 200 within housing 110. Locking member 200 may be moved to a locked position in which portion 212 of locking member 200 may engage (e.g., substantially entirely engage) with portion 202 of housing member 120 and/or portions 206 and/or 208 of housing member 125 to lock housing members 120 and 125 together. Locking member 200 may also be moved to an unlocked position in which portion 212 of locking member 200 may be disengaged from portion 202 of housing member 120 and/or portions 206 and/or 208 of housing member 125 to unlock housing members 120 and 125. Portion 212 of locking member 200 may thereby selectively engage with portion 202 of housing member 120 and/or portions 206 and/or 208 of housing member 125 (e.g., portions of locking member 200 may selectively engage with portions of housing 110 to selectively lock housing 110).

As illustrated in FIGS. 5 and 6, locking member 200 of locking assembly 127 may also include a protrusion 214 disposed at an exterior surface 216 of locking member 200. Protrusion 214 may provide a point of contact for assisting a user in selectively moving locking member 200 between a locked and an unlocked position. An additional point of contact may also be located, for example, at an end portion (e.g., tail end) of locking member 200. As illustrated in FIG. 3, locking assembly 127 may also include a locking indicator 218 that may be disposed on housing member 120 and/or housing member 125 (e.g., or any other suitable portion of housing 110). Locking indicator 218 may include a locked indicator 220 and an unlocked indicator 222 that may indicate to a user whether cutting device 105 is in a locked or an unlocked state based on a position of locking member 200 (e.g., an engagement of locking member 200 with portions of housing members 120 and 125). It is contemplated that locking assembly 127 may also include any suitable assemblies for locking housing members 120 and 125 such as, for example, a twist-lock connection, a snap connection, a screw-type connection, an adhesive connection, a hook and loop connection, or any other suitable type of (e.g., mechanical) connection.

As illustrated in FIGS. 6 and 9-12, cutting assembly 115 may include a carriage 230, a member 235, and one or more cutting members 240. One or more cutting members 240 may be removably disposable in carriage 230 (e.g., a blade carriage). Carriage 230 may be movably disposed within housing 110. For example, carriage 230 may be movably disposed within cavity 135, which may be configured to receive carriage 230 as described for example herein. Carriage 230 may include a plurality of wall portions (e.g., portion 252 and portion 254). Portions (e.g., portion 174 and portion 176) of housing member 120 may act as guides or ribs that contact corresponding portions (e.g., portion 252 and portion 254) of carriage 230. The interaction of corresponding portions (e.g., portions 174 and 176) of housing member 120 and portions (e.g., portions 252 and 254) of carriage 230 may allow carriage 230 to move (e.g., slide or translate in a forward or rearward direction along a length of cutting device 105) within housing 110 without rotation (e.g., the interaction of the portions of carriage 230 and housing 110 may substantially prevent a rotation of carriage 230 as it moves within housing 110, e.g., when housing members 120 and 125 are attached or integral with each other as part of housing 110). For example, carriage 230 may move within housing 110 between an extended position as illustrated in FIG. 1 and a retracted position as illustrated in FIG. 2. For example, carriage 230 may be moved to the retracted position, the extended position, or any position between the retracted position and the extended position.

Figure 13:
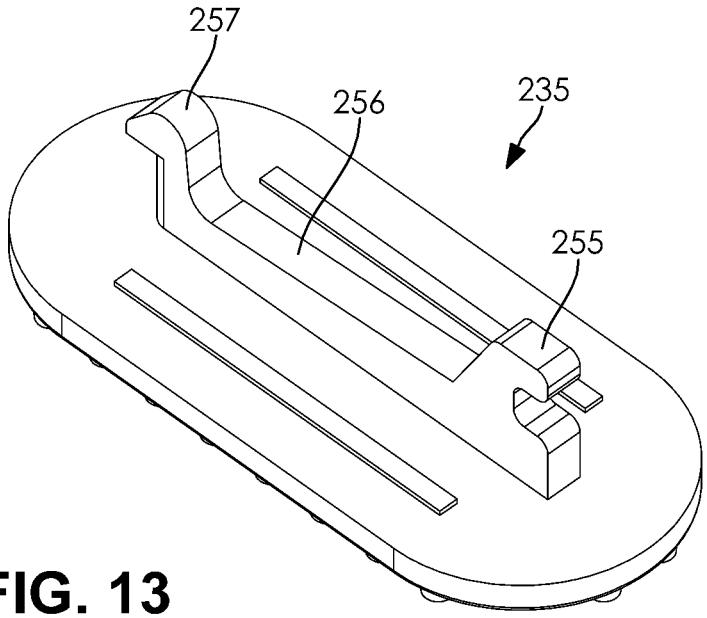
FIG. 13 is a perspective view of a portion of an exemplary cutting device in accordance with an embodiment of the present invention.
Figure 14:
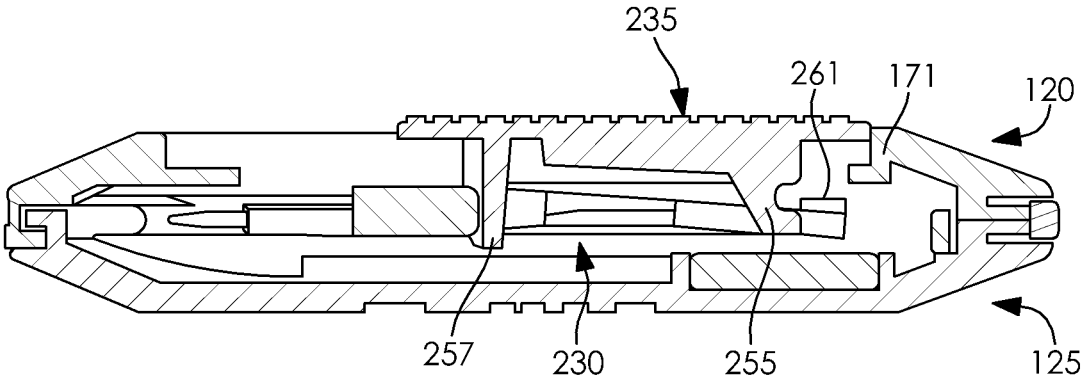
FIG. 14 is a sectional view of an exemplary cutting device in accordance with an embodiment of the present invention.

Member 235 may be attached (e.g., removably attached or fixedly attached) to carriage 230. Member 235 may be sized to fit within recess 170 of housing member 120. For example, member 235 may have a width that is sized to fit within a width of recess 170. Member 235 may have a length that is less than a length of recess 170 so that member 235 may be moved within recess 170 (e.g., moved along a length of recess 170). Member 235 may include a portion 255 and a portion 257 that may protrude from a surface (e.g., a bottom surface) of member 235. Portions 255 and 257 may pass through aperture 172. For example, portion 255 may pass through aperture 172 and be received within an aperture 258 of carriage 230. Also for example, portion 257 may pass through aperture 172 and be received within an aperture 259 of carriage 230. Apertures 258 and 259 may be disposed in a central portion 260 of carriage 230. As illustrated for example in FIG. 14, portions 255 and 257 may have protruding portions that may be received under respective edge portions **258*a* and 259*a* of apertures 258 and 259 to hold member 235 firmly in place with housing member 120 and carriage 230. As illustrated in FIG. 13, portions 255 and 257 may be attached to or integrally formed with an elongated portion 256 of member 235. Elongated portion 256 may be sized to be received by and to move back and forth along portions 172***a* and 172*b* of aperture 172.

Returning to FIG. 6, member 235 may thereby be removably attached to carriage 230 based on portions 255 and 257 of member 235 passing through aperture 172 of housing member 120 and being received in carriage 230. Accordingly for example, member 235, housing member 120, and carriage 230 may be attached, with member 235 and carriage 230 being movably disposed along housing member 120. For example, a range of movement of member 235 and carriage 230 along housing member 120 may be defined by a range of movement of portions 255 and 257 along respective lengths of portions 172*a* and 172*b* of aperture 172. For example, when housing members 120 and 125 are detached, carriage 230 and member 235 of cutting assembly 115 may be movably attached to housing member 120. Alternatively for example, when a user detaches housing members 120 and 125, carriage 230 and member 235 may remain for example attached to housing member 120. It is also contemplated that cutting assembly 115 may removably attachable to other suitable portions or surface portions of housing 110. Also for example, carriage 230 may include a protrusion 261 that may be disposed at an edge portion of central portion 260. As described for example further below, protrusion 261 may be selectively received in portions 172*c* and 172*d* of aperture 172. As described for example further below, central portion 260 may be a flexible portion that may be urged based on a user applying a pressing force to member 235 that may be imparted to central portion 260 of carriage 230.

Member 235 may include a plurality of protrusions 264 such as ridges or other suitable tactile protrusions disposed on a surface 266 of member 235. A user of cutting device 105 may interact with member 235 to move carriage 230 within housing 110. Protrusions 264 may assist a user with maintaining positive contact (e.g., non-slipping contact) with member 235 as the user pushes or pulls at member 235.

Figure 9:
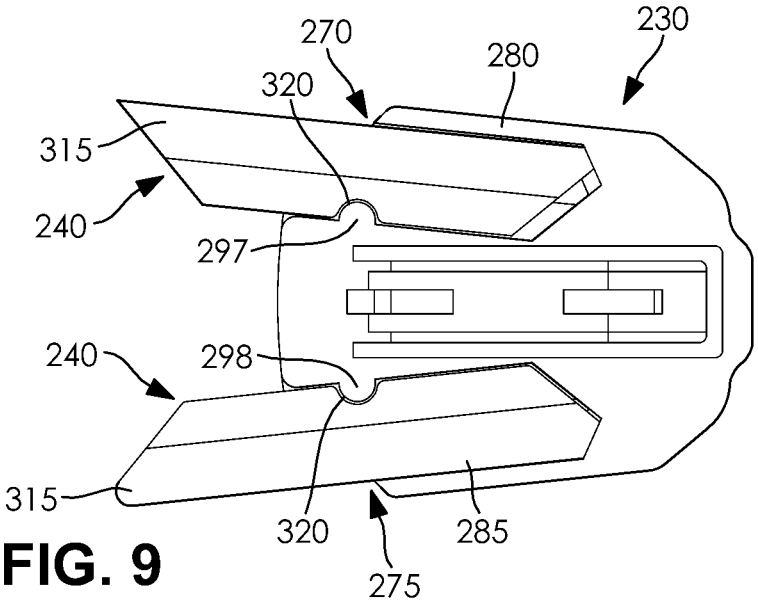
FIG. 9 is a top view of a portion of an exemplary cutting device in accordance with an embodiment of the present invention.
Figure 10:
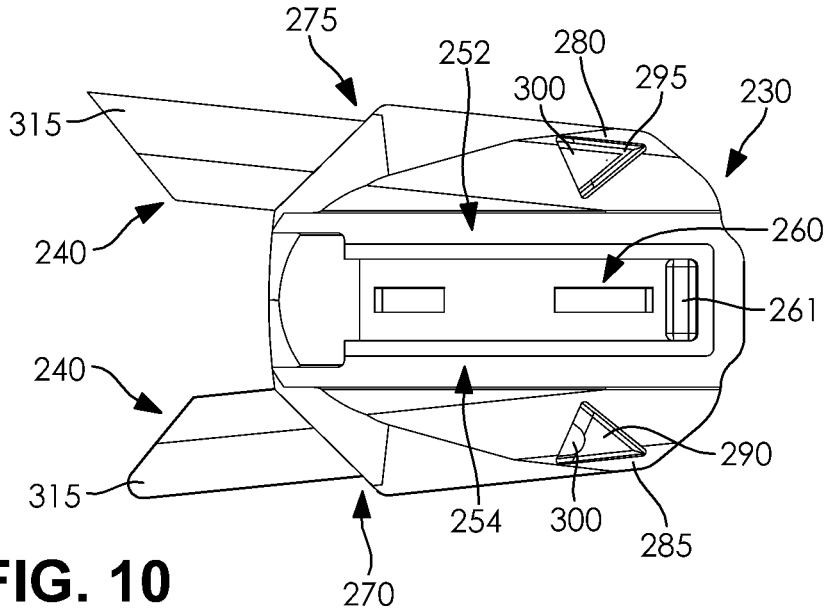
FIG. 10 is a top view of a portion of an exemplary cutting device in accordance with an embodiment of the present invention.
Figure 11:
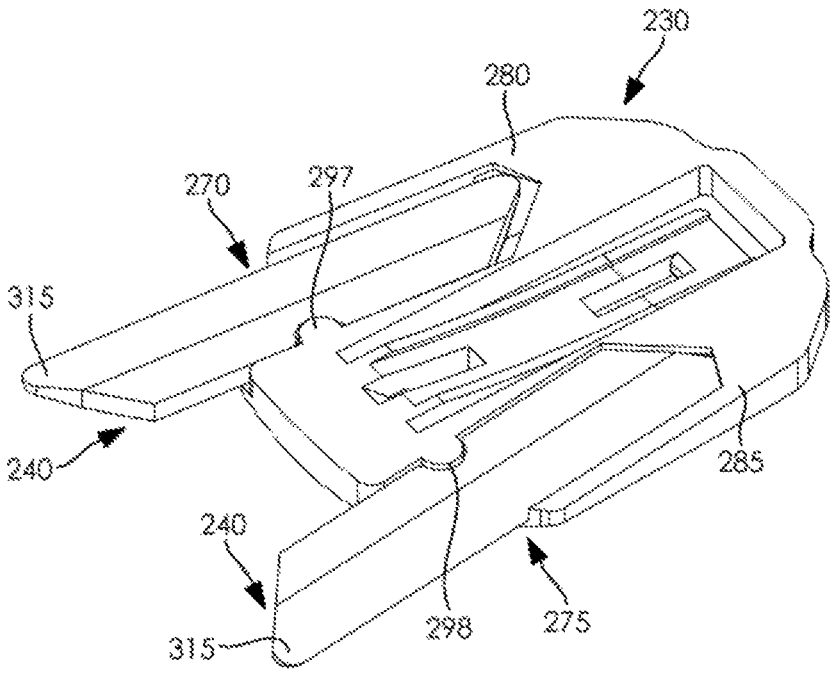
FIG. 11 is a perspective view of a portion of an exemplary cutting device in accordance with an embodiment of the present invention.
Figure 12:
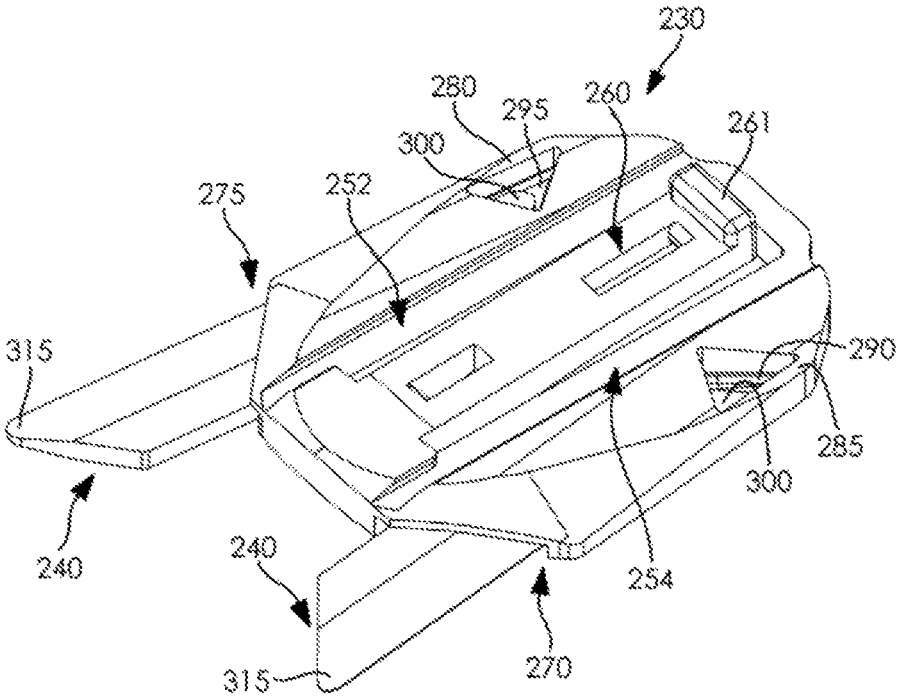
FIG. 12 is a perspective view of a portion of an exemplary cutting device in accordance with an embodiment of the present invention.

As illustrated in FIGS. 9-12, carriage 230 may include one or more attachment portions (e.g., cavity 270 and cavity 275) that may be formed by a plurality of portions (e.g., portion 280 and portion 285) of carriage 230. The one or more attachment portions may be, for example, a cavity, a mechanical assembly (e.g., having a latch), a location for adhesive connection, and/or a hook and loop connection. Cavities 270 and 275 may be configured (e.g., shaped and/or sized) to receive a portion of cutting member 240. For example, as illustrated in FIG. 10 that illustrates a plan view of carriage 230 that may face housing member 120, cavity 270 may include a portion 290 and cavity 275 may include a portion 295. Portions 290 and 295 may each be configured to receive an end portion 300 of cutting members 240. Carriage 230 may also include a plurality of portions (e.g., portions 297 and 298) that may be received in corresponding recesses of cutting member 240. Cavities 270 and 275 may each thereby securely retain cutting member 240 in such a manner so as to substantially prevent cutting member 240 from becoming dislodged or otherwise falling out of carriage 230. The securing of one or more cutting members 240 in cavities 270 and 275 of carriage 230 may also be for example a friction-fit attachment between cutting member 240 and portions 280, 285, 290, 295, 297, 298 and/or other portions of cavities 270 and 275 and/or carriage 230.

In at least some exemplary embodiments, carriage 230 may include a first attachment portion (e.g., cavity 270), which may be disposed at a first portion of carriage 230, and a second attachment portion (e.g., cavity 275), which may be disposed at a second portion of carriage 230 that may be disposed away from the first portion of carriage 230. Further for example, cutting member 240 may be removably attachable to the first attachment portion (e.g., cavity 270) at the first portion of carriage 230, and the same cutting member 240 (e.g., or a different cutting member 240) may be removably attachable to the second attachment portion (e.g., cavity 275) at the second portion of carriage 230. For example, the first attachment portion (e.g., cavity 270) may be disposed at a first half of carriage 230 and the second attachment portion (e.g., cavity 275) may be disposed at a second half of carriage 230. Also for example, housing 110 may include a first aperture (e.g., aperture 150) configured to receive cutting member 240 when attached to the first attachment portion (e.g., cavity 270) and a second aperture (e.g., aperture 148) configured to receive cutting member 240 when attached to the second attachment portion (e.g., cavity 275). Further for example, the first aperture (e.g., aperture 150) and the first attachment portion (e.g., cavity 270) may be aligned symmetrically to the second aperture (e.g., aperture 148) and the second attachment portion (e.g., cavity 275) about a centerline of cutting device 105.

Also for example, a user may removably attach cutting member 240 to either the first attachment portion (e.g., cavity 270) or the second attachment portion (e.g., cavity 275) based on whether a user is right-handed or left-handed. Further for example, a user may move cutting member 240 when removably attached to the first attachment portion (e.g., cavity 270) to the extended position so that cutting member 240 (e.g., portion 315) extends through an aperture (e.g., aperture 148 or 150) of housing 110 that is aligned with the first half of carriage 230. Additionally for example, a user may move cutting member 240 when removably attached to the second attachment portion (e.g., cavity 275) to the extended position so that cutting member 240 extends through an aperture (e.g., aperture 148 or 150) of housing 110 that is aligned with the second half of carriage 230. Also for example, a user may removably attach cutting member 240, including removably attaching cutting member 240 to either the first attachment portion (e.g., cavity 270) or the second attachment portion (e.g., cavity 275) when first housing member 120 is both unlocked from and detached from second housing member 125.

Cutting member 240 may be any suitable blade or cutter for cutting of a material by cutting device 105. For example, cutting member 240 may be formed from a ceramic material that is capable of withstanding extended use before becoming dull or unusable. For example, cutting member 240 may be a ceramic blade. For example, cutting member 240 may include ceramic materials such as Zirconium Oxide or any other suitable ceramic materials for use in a blade. For example, cutting member 240 may be a ceramic blade that may be a hooked blade formed from Zirconium Oxide. Alternatively for example, cutting member 240 may be a metal blade or a blade formed from any suitable material than can be used for cutting materials.

Cutting member 240 may include rounded tips to reduce the chance of a user being cut unintentionally by cutting member 240.

As illustrated in FIGS. 6, 9, and 10, cutting member 240 may include a portion 315 that may be used for cutting material. Cutting member 240 may be of any suitable shape or configuration for cutting material. Portion 315 may be a relatively narrow portion (e.g., narrower relative the other portions of cutting member 240) of cutting member 240 that may serve to cut material. Cutting member 240 may also include a recess 320 (e.g., indentation, notch or other suitable type of recess) that may receive portions 297 or 298 of carriage 230 to help retain one or more cutting members 240 in carriage 230. For example, cutting member 240 may include a recess (e.g., recess 320) configured to receive a first protrusion (e.g., portion 297) of the first attachment portion (e.g., cavity 270) and/or a second protrusion (e.g., portion 298) of the second attachment portion (e.g., cavity 275).

It is contemplated that cutting assembly 115 may be locked in the position illustrated in FIG. 1. For example, cutting assembly 115 may be lockable in a forward position so as to cause cutting member 240 to remain extended out of aperture 148 and/or 150 of housing 110. Cutting assembly 115 may be locked in the forward position by any suitable locking device such as, for example, a friction fit locking device, a latching mechanism, and/or a ratcheting mechanism.

In at least some exemplary embodiments, the exemplary disclosed cutting device may include a first housing member (e.g., housing member 120), a second housing member (e.g., housing member 125) that is removably attachable to the first housing member to form a housing, and a carriage (e.g., carriage 230) that is movably disposed in the housing, the carriage including a first attachment portion (e.g., cavity 270), which is disposed at a first portion of the carriage, and a second attachment portion (e.g., cavity 275), which is disposed at a second portion of the carriage that is disposed away from the first portion of the carriage. The exemplary cutting device may also include an exterior member (e.g., member 235) disposed at an exterior of the housing and attached to the carriage via an aperture (e.g., aperture 172) disposed in one of the first housing member and the second housing member, and a cutting member (e.g., cutting member 240) that is removably attachable to the first attachment portion at the first portion of the carriage. The cutting member may be removably attachable to the second attachment portion at the second portion of the carriage. The carriage may include a protrusion (e.g., protrusion 261). The aperture may include a first aperture portion (e.g., portion 172*c*) and a second aperture portion (e.g., portion 172*d*). The protrusion may be selectively receivable in the first aperture portion and in the second aperture portion. When the protrusion may be received in the first aperture portion, then the carriage may be in a retracted position. When the protrusion may be received in the second aperture portion, then the carriage may be in an extended position. The protrusion may be movable toward an interior of the housing when a force is applied to the exterior member. The protrusion may be selectively removable from the first aperture portion or the second aperture portion when the force is applied to the exterior member. When the protrusion is received in the first aperture portion, then the carriage may be temporarily locked in the retracted position. When the protrusion is received in the second aperture portion, then the carriage may be temporarily locked in the extended position. The aperture may include a third aperture portion (e.g., portion 172*a*) and a fourth aperture portion (e.g., portion 172*b*). The third aperture portion and the fourth aperture portion may be elongated grooves extending in a longitudinal direction of the cutting device, and the first aperture portion and the second aperture portion may be elongated grooves extending in a transverse direction of the cutting device that may be substantially perpendicular to the longitudinal direction of the cutting device. The third aperture portion may connect the first aperture portion and the second aperture portion, and the fourth aperture portion may extend from the second aperture portion in a direction extending away from the first aperture portion. The cutting member may be formed from Zirconium Oxide. The exemplary disclosed cutting device may include a movable locking member (e.g., locking member 200 having portion 212) that is received by portions of the first and second housing members, the movable locking member configured to move to selectively unlock and lock the first and second housing members together.

In at least some exemplary embodiments, the exemplary disclosed cutting device may include a first housing member (e.g., housing member 120), and a second housing member (e.g., housing member 125) that is removably attachable to the first housing member to form a housing. The exemplary disclosed cutting device may also include a carriage (e.g., carriage 230) that is movably disposed in the housing, the carriage including a first cavity (e.g., cavity 270), which is disposed at a first portion of the carriage, and a second cavity (e.g., cavity 275), which is disposed at a second portion of the carriage that is disposed away from the first portion of the carriage, and a cutting member (e.g., cutting member 240) that is removably disposable in the first cavity at the first portion of the carriage. The cutting member (e.g., cutting member 240) may be removably disposable in the second cavity at the second portion of the carriage. The cutting member may be a ceramic blade. The carriage may include a protrusion (e.g., a protrusion 261). At least one of the first housing member and the second housing member may include an aperture (e.g., aperture 172) having a first aperture portion (e.g., portion 172*c*) and a second aperture portion (e.g., portion 172*d*). The protrusion may be selectively receivable in the first aperture portion and in the second aperture portion. The aperture may include a third aperture portion (e.g., portion 172*a*) and a fourth aperture portion (e.g., portion 172*b*). The third aperture portion and the fourth aperture portion may be elongated grooves extending in a longitudinal direction of the cutting device, and the first aperture portion and the second aperture portion may be elongated grooves extending in a transverse direction of the cutting device that may be substantially perpendicular to the longitudinal direction of the cutting device. The third aperture portion may connect the first aperture portion and the second aperture portion, and the fourth aperture portion may extend from the second aperture portion in a direction extending away from the first aperture portion. When the protrusion may be received in the first aperture portion, then the carriage may be locked in the retracted position. When the protrusion may be received in the second aperture portion, then the carriage may be locked in the extended position. The protrusion may be removable from the first and second aperture portions based on moving the protrusion toward an interior of the housing. The exemplary disclosed cutting may also include a slidable locking member (e.g., locking member 200 having portion 212) that is received by portions of the first and second housing members, the sliding locking member configured to slide to selectively unlock and lock the first and second housing members together.

The exemplary disclosed device and method may provide an intuitively simple and safe technique for cutting materials and/or replacing blades of a cutting device for left-handed users, right-handed users, and/or ambidextrous users. The exemplary disclosed device and method may be used in any application involving cutting materials safely. For example, the exemplary cutting device and method may be used in applications such as pocket cutters, seam rippers, box cutters, utility knives, precision knives, and any other suitable application for cutting materials.

Figure 17:
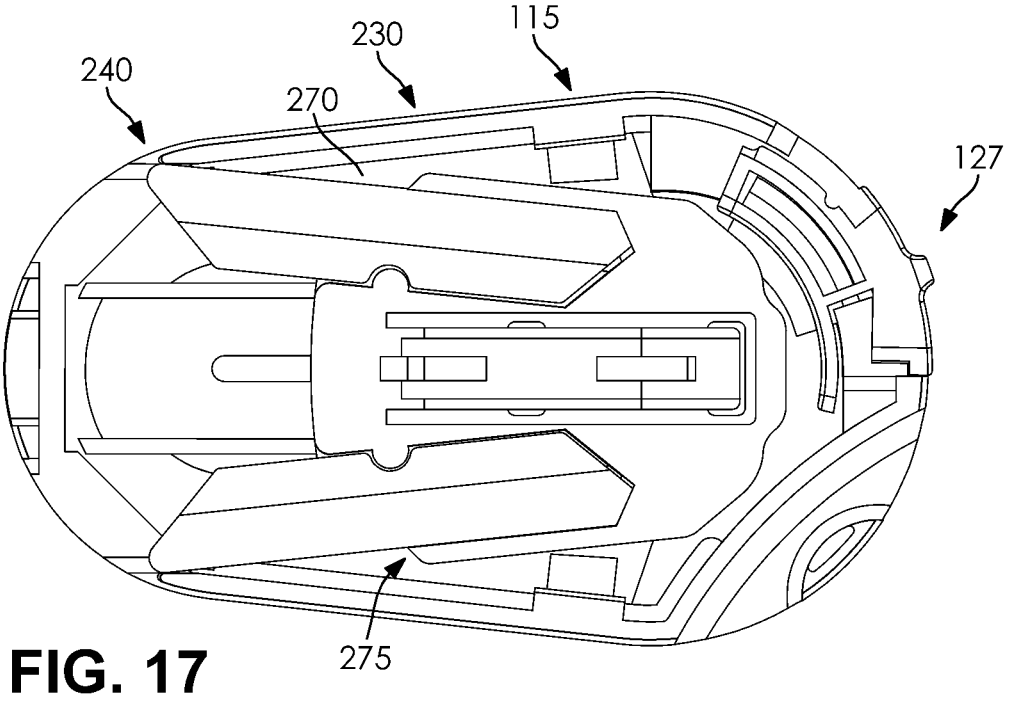
FIG. 17 is a top view of a portion of an exemplary cutting device in accordance with an embodiment of the present invention.
Figure 18:
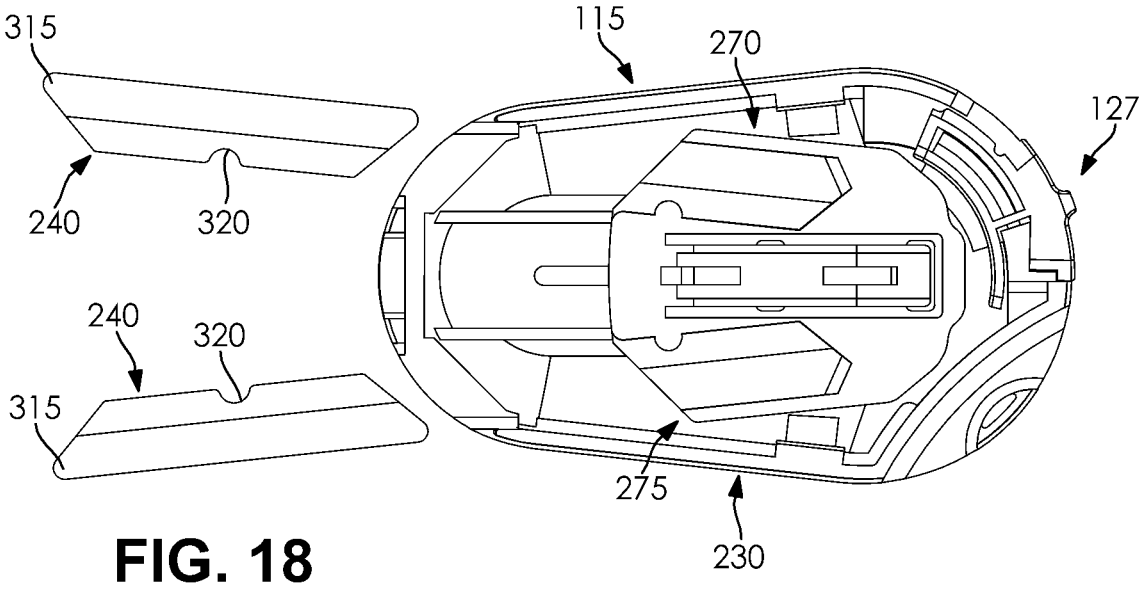
FIG. 18 is a top view of a portion of an exemplary cutting device in accordance with an embodiment of the present invention.

An exemplary operation of cutting device 105 will now be described. As illustrated in FIG. 6, cutting device 105 including housing 110 and cutting assembly 115 may be provided. Cutting device 105 may for example be in a left-handed configuration as illustrated in FIG. 17. In this configuration for example, left-handed users (e.g., or ambidextrous users; and it is also contemplated that right-handed users may use this configuration if desired) may hold cutting device 105 in their left hand with a single cutting member 240 being disposed at a top of cutting device 105 (e.g., disposed in cavity 270) and member 235 having gripping protrusions 264 being on a right side of cutting device 105 (e.g., by the left thumb of users). Left-handed users (e.g., or ambidextrous users) may accordingly comfortably and easily use cutting device 105 to cut material as desired, with cutting device 105 positioned comfortably for left-handed (or ambidextrous) users to extend and retract cutting member 240 using their left thumb to push member 235.

Figure 15:
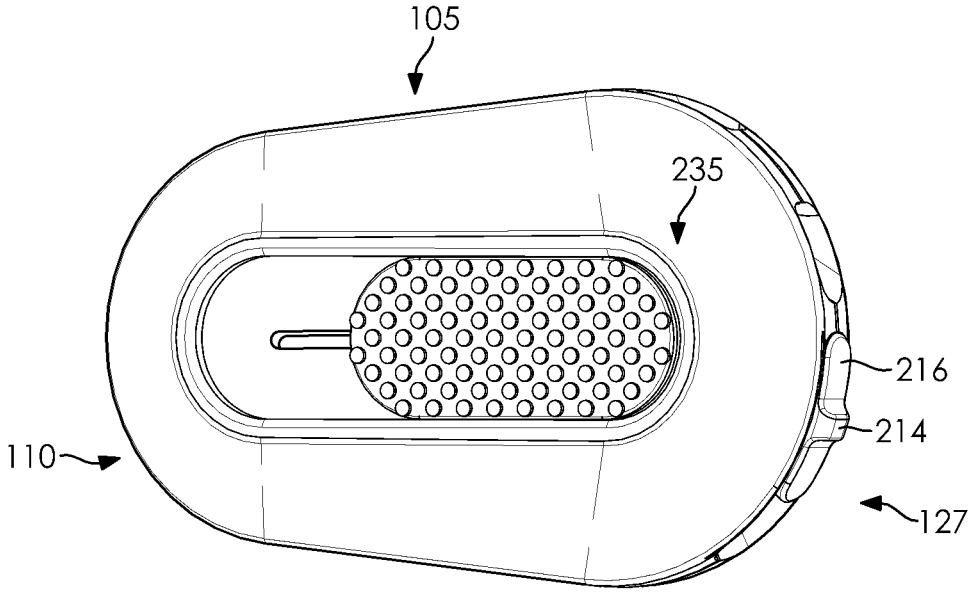
FIG. 15 is a perspective view of an exemplary cutting device in accordance with an embodiment of the present invention.
Figure 16:
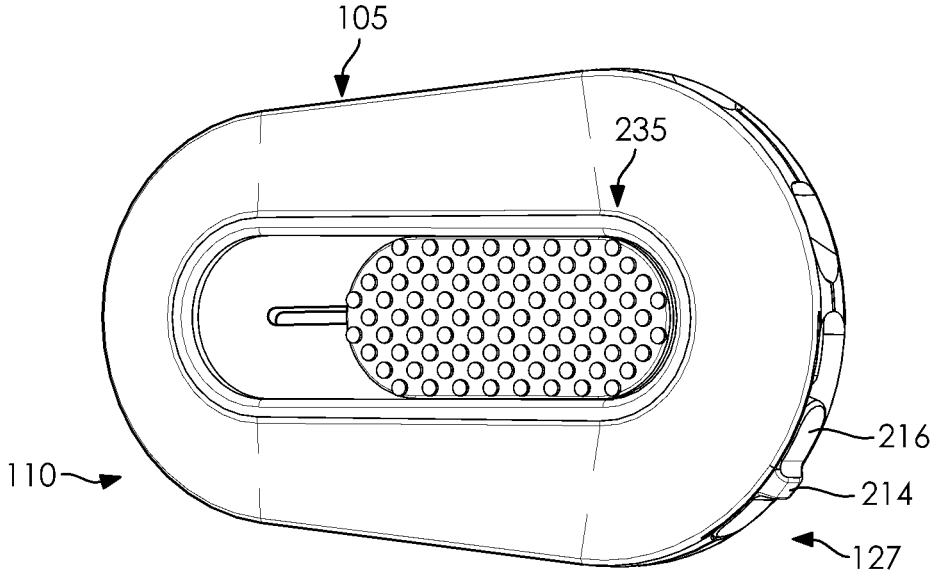
FIG. 16 is a perspective view of an exemplary cutting device in accordance with an embodiment of the present invention.

The user may unlock cutting device 105 by moving locking assembly 127 from the exemplary locked position illustrated in FIG. 15 to the exemplary unlocked position illustrated in FIG. 16 by pushing (e.g., or pulling or toggling) protrusion 214. When cutting device 105 is unlocked, a user may detach housing member 120 from housing member 125 as illustrated in FIG. 6. As illustrated in FIGS. 6 and 17-20 and as described for example above, carriage 230 may be retained (e.g., by member 235) on housing member 120 when a user detaches housing member 120 from housing member 125. Also for example, locking member 200 and magnetic component 194 may be retained on housing member 125 when a user detaches housing member 120 from housing member 125.

Figure 19:
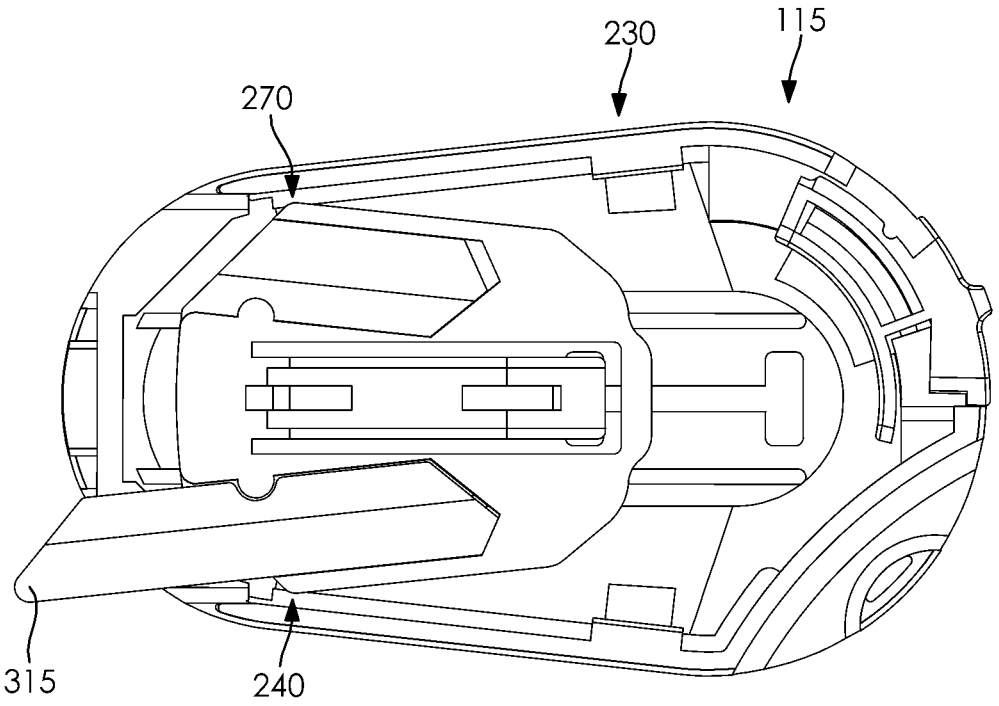
FIG. 19 is a top view of a portion of an exemplary cutting device in accordance with an embodiment of the present invention.
Figure 20:
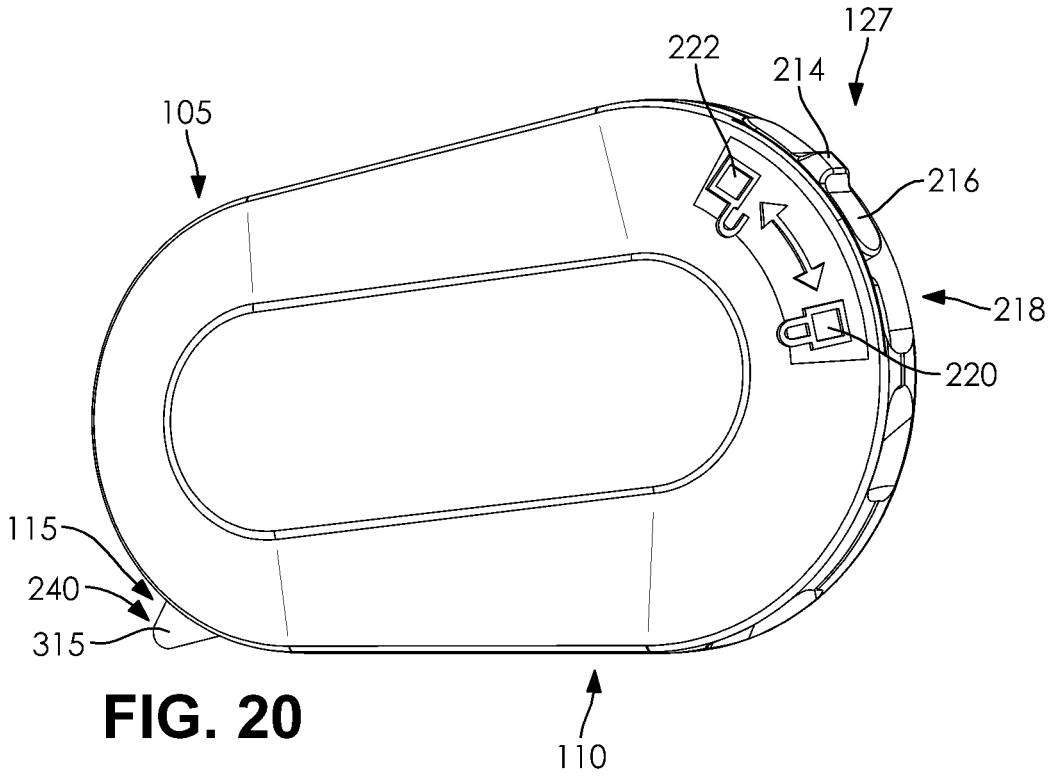
FIG. 20 is a perspective view of an exemplary cutting device in accordance with an embodiment of the present invention.

When housing members 120 and 125 are detached from each other, a user may either replace cutting members and/or change the configuration of cutting device 105 as desired. For example, left-handed (e.g., or ambidextrous) users may remove a cutting member 240 that has been used for a prolonged period from cavity 270 and insert a new cutting member 240 in cavity 270. A user may also place cutting members 240 in both of cavities 270 and 275 or remove cutting members 240 from both cavities 270 and 275 as illustrated in FIG. 15. For example, a user may insert cutting member 240 so that recess 320 of cutting member 240 receives portions 297 or 298 of carriage 230. A user may also change a configuration or orientation of cutting device 105 from a left-handed device to a right-handed device (e.g., or from a right-handed device to a left-handed device). For example, a user may remove cutting member 240 from cavity 270 and either insert the same or a new cutting member 240 into cavity 275 as illustrated in FIG. 19. It is also contemplated that a user may make similar configuration changes and cutting member replacements via apertures 148 and/or 150 in the case that housing 110 is an integral housing having housing members 120 and 125 that are integrally formed portions of an integral housing 110.

For example when a single cutting member 240 is inserted in cavity 275, a user may attach housing members 120 and 125. Once housing members 120 and 125 are aligned and attached, the user may lock housing 110 by moving locking assembly 127 from the unlocked position illustrated in FIG. 16 to the locked position illustrated in FIG. 15. Cutting device 105 may now be in a right-handed configuration as illustrated in FIGS. 1 and 2. In this configuration for example, right-handed users (e.g., or ambidextrous users; and it is also contemplated that left-handed users may use this configuration if desired) may hold cutting device 105 in their right hand with a single cutting member 240 being disposed at a top of cutting device 105 (e.g., disposed in cavity 275) and member 235 having gripping protrusions 264 being on a left side of cutting device 105 (e.g., by the right thumb of users). Right-handed users (e.g., or ambidextrous users) may accordingly comfortably and easily use cutting device 105 to cut material as desired, with cutting device 105 positioned comfortably for right-handed (or ambidextrous) users to extend and retract cutting member 240 using their right thumb to push member 235. Also for example, in the right-handed configuration, cutting member 240 may be disposed in either cavity 270 or cavity 275 depending on the angle and location at which an object is to be cut (e.g., depending on whether an object located above or below a user is to be cut).

Similar (e.g., and reversed) to the steps described above, a user may reconfigure cutting device 105 from a right-handed configuration to a left-handed configuration. For example, a user may detach housing members 120 and 125, and remove cutting member 240 from cavity 275. The user may insert the same cutting member 240 or a new cutting member 240 into cavity 270. The user may then attach housing members 120 and 125. Once housing members 120 and 125 are aligned and attached, the user may lock housing 110 by moving locking assembly 127 from the unlocked position illustrated in FIG. 16 to the locked position illustrated in FIG. 15. Cutting device 105 may now be again in the left-handed configuration as illustrated in FIG. 17.

As described above, a configuration of the same cutting device 105 may thereby be changed as desired to be in either a left-handed or right-handed configuration by either the same user or different users. Users may store or carry cutting device 105 for example by using aperture 168 as an attachment point for attaching a lanyard or for receiving other suitable carrying or storage assemblies such as a hook, a string, or a wire. Users may also use magnetic component 194 disposed in housing 110 as desired to hold or secure replacement blades, secure or store cutting device 105 on a magnetic and/or metallic surface, and/or pick up small magnetic objects such as nails, screws, or other intricate objects.

In both the left-handed and right-handed configurations (e.g., when housing 110 is in a locked state), a user of cutting device 105 may push member 235 to move cutting assembly 115 between an extended position as illustrated for example in FIG. 1 and a retracted position as illustrated for example in FIG. 2. For example, when cutting device 105 is in the retracted position illustrated in FIG. 2, protrusion 261 of carriage 230 may be received in portion 172*c* of aperture 172. Based on protrusion 261 being received in portion 172*c*, a movement of cutting assembly 115 may be substantially prevented (e.g., protrusion 261 may not move from portion 172*c* to narrower portion 172*a*).

A user may press on surface 266 of member 235 to urge member 235 inward toward cavity 135. The inward force may be imparted to carriage 230 (e.g., via the attachment between member 235 and carriage 230 through aperture 172), thereby moving central portion 260 (e.g., or alternatively all of carriage 230) away from aperture 172 and inward toward cavity 135. Protrusion 261 may thereby be disengaged from portion 172*c* of aperture 172, which may allow cutting assembly 115 to move within cavity 135 of cutting device 105. The user may push member 235 toward a front of cutting device 105, which moves cutting assembly 115 toward an extended position as illustrated for example in FIG. 1. Protrusion 261 may thereby be moved from portion 172*c* toward portion 172*d* of aperture 172. As cutting assembly 115 moves forward, a portion of elongated portion 256 may remain within portion 172*a* and/or 172*b* of aperture 172 to help maintain a substantially straight movement of cutting assembly 115 within cavity 135. Once protrusion 261 has reached a location of portion 172*d*, a user may release (e.g., stop pressing) member 235, and central portion 260 (e.g., or all of carriage 230) may move away from cavity 135. Protrusion 261 may thereby be received in portion 172*d* of aperture 172. Based on protrusion 261 being received in portion 172*d*, a movement of cutting assembly 115 may be substantially prevented (e.g., protrusion 261 may not move from portion 172*d* to narrower portions 172*a* or 172*b*). Cutting assembly 115 may thereby be held (e.g., locked or temporarily locked) in the extended position. Elongated portion 256 may be received in portion 172*b* in the extended position. Also, an end portion of member 235 may abut against portion 171 of recess 170, further preventing further forward movement of member 235 and cutting assembly 115. A user may then be free to use cutting device 105 to cut an object or material as described for example herein. Because protrusion 261 being received in portion 172*d* may substantially prevent a movement of cutting assembly 115, cutting device 105 may be maintained in the extended position without the user applying any force to member 235. For example, cutting device 105 may be maintained (e.g., locked or temporarily locked) in the extended position.

When for example a user is finished using cutting device 105 and/or would like to move cutting device 105 from the extended position to the retracted position, the user may follow a substantially reverse order of steps to return cutting device 105 to a retracted position. A user may press on surface 266 of member 235 to urge member 235 inward toward cavity 135. The inward force may be imparted to carriage 230 (e.g., via the attachment between member 235 and carriage 230 through aperture 172), thereby moving central portion 260 (e.g., or alternatively all of carriage 230) away from aperture 172. Protrusion 261 may thereby be disengaged from portion 172*d* of aperture 172, which may allow cutting assembly 115 to move rearwards or backwards within cavity 135 of cutting device 105. The user may push member 235 toward a back or rear of cutting device 105, which moves cutting assembly 115 toward the retracted position as illustrated for example in FIG. 2. Protrusion 261 may thereby be moved from portion 172*d* toward portion 172*c* of aperture 172. As cutting assembly 115 moves forward, a portion of elongated portion 256 may remain within portion 172*a* and/or 172*b* of aperture 172 to help maintain a substantially straight movement of cutting assembly 115 within cavity 135. Once protrusion 261 has reached a location of portion 172*c*, a user may release (e.g., stop pressing) member 235, and central portion 260 (e.g., or all of carriage 230) may move away from cavity 135. Protrusion 261 may thereby be received in portion 172*c* of aperture 172. Based on protrusion 261 being received in portion 172*c*, a movement of cutting assembly 115 may be substantially prevented (e.g., protrusion 261 may not move from portion 172*c* to narrower portion 172*a*). Cutting assembly 115 may thereby be held (e.g., locked or temporarily locked) in the retracted position. Elongated portion 256 may be received in portion 172*a* in the retracted position. Also, an end portion of member 235 may abut against portion 171 of recess 170, further preventing further backward or rearward movement of member 235 and cutting assembly 115. The user may then be free to for example safely store cutting device 105 (e.g., put cutting device 105 into his or her pocket).

Cutting assembly 115 may be moved between the retracted position illustrated in FIGS. 2 and 17 to the extended position illustrated in FIGS. 1 and 19. A user may move cutting assembly 115 by pushing member 235. To move cutting assembly 115 to the extended position, the user may apply a first force (e.g., user force or moving force) to cutting assembly 115 in an extending direction (e.g., a direction toward the extended position). The extending direction may be a substantially opposite direction as the retracting direction. When cutting assembly 115 is in the extended position, some or all of portion 315 of one or more cutting members 240 may extend through and out of apertures 148 and/or 150 of housing 110. In the extended position illustrated for example in FIGS. 1, 19, and 20, a user may use cutting device 105 to cut material using portion 315 of cutting member 240. It is contemplated that cutting assembly 115 may be locked in the extended position (e.g., or at any point between the extended position and the retracted position) by any suitable locking device.

The exemplary disclosed method may include removably attaching a first housing member (e.g., housing member 120) to a second housing member (e.g., housing member 125) to form a housing, at least one of the first housing member and the second housing member including an aperture (e.g., aperture 172) having a first aperture portion (e.g., portion 172*c*) and a second aperture portion (e.g., portion 172*d*), movably disposing a carriage (e.g., carriage 230) in the housing, the carriage including a protrusion (e.g., protrusion 261), and removably attaching a cutting member (e.g., cutting member 24) to a first attachment portion (e.g., cavity 270) disposed at a first half of the carriage. The exemplary disclosed method may also include removably attaching the cutting member to a second attachment portion (e.g., cavity 275) disposed at a second half of the carriage, and selectively receiving the protrusion in the first aperture portion and in the second aperture portion. The exemplary disclosed method may also include moving the protrusion toward an interior of the housing and removing the protrusion from the first aperture portion or the second aperture portion based on moving the protrusion toward the interior of the housing. The exemplary disclosed method may also include selectively locking the carriage in a retracted position by receiving the protrusion in the first aperture portion, and selectively locking the carriage in an extended position by receiving the protrusion in the second aperture portion. The exemplary disclosed method may further include moving the carriage between the retracted position and the extended position when the protrusion is removed from the first and second aperture portions based on moving the protrusion toward the interior of the housing. The exemplary disclosed method may further include moving a locking member (e.g., locking member 200 having portion 212) that is received by portions of the first and second housing members to selectively unlock and lock the first and second housing members together.

The exemplary disclosed cutting device and method may provide an intuitively simple device and technique for using a cutting device and for safely and easily replacing blades of the cutting device for both left-handed, right-handed users, and ambidextrous users. The exemplary device may allow both left-handed and right-handed users unfamiliar with the device to easily and safely use the device and replace the blades and to reconfigure the cutting device in a left-handed or a right-handed configuration as desired. The exemplary device and method may also provide either a left-handed or right-handed user with a cutting device having a blade that may be resistant to dulling and may be used for relatively long periods of time without replacing a blade. The exemplary device and method may provide an ergonomically efficient device and method that allows a left-handed or right-handed user to avoid frustration in using a cutting device, including during replacement of the device blades. The exemplary device and method may also provide a cutting device that can be used easily by ambidextrous users.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A cutting device, comprising:

a first housing member;

a second housing member that is removably attachable to the first housing member to form a housing;

a carriage that is movably disposed in the housing, the carriage including a first attachment portion, which is disposed at a first portion of the carriage, and a second attachment portion, which is disposed at a second portion of the carriage that is disposed away from the first portion of the carriage;

an exterior member disposed at an exterior of the housing and attached to the carriage via an aperture disposed in one of the first housing member and the second housing member; and a cutting member that is removably attachable to the first attachment portion at the first portion of the carriage;

wherein the cutting member is removably attachable to the second attachment portion at the second portion of the carriage;

wherein the carriage includes a protrusion;

wherein the aperture includes a first aperture portion, a second aperture portion, a third aperture portion, and a fourth aperture portion wherein the third aperture portion and the fourth aperture portion are elongated grooves extending in a longitudinal direction of the cutting device, and the first aperture portion and the second aperture portion are elongated grooves extending in a transverse direction of the cutting device that is substantially perpendicular to the longitudinal direction of the cutting device; and wherein the protrusion is selectively receivable in the first aperture portion and in the second aperture portion.

2. The cutting device of claim 1, wherein when the protrusion is received in the first aperture portion then the carriage is in a retracted position, and when the protrusion is received in the second aperture portion then the carriage is in an extended position.

3. The cutting device of claim 1, wherein the protrusion is movable toward an interior of the housing when a force is applied to the exterior member.

4. The cutting device of claim 3, wherein the protrusion is selectively removable from the first aperture portion or the second aperture portion when the force is applied to the exterior member.

5. The cutting device of claim 2, wherein when the protrusion is received in the first aperture portion then the carriage is temporarily locked in the retracted position, and when the protrusion is received in the second aperture portion then the carriage is temporarily locked in the extended position.

6. The cutting device of claim 1, wherein the third aperture portion connects the first aperture portion and the second aperture portion, and the fourth aperture portion extends from the second aperture portion in a direction extending away from the first aperture portion.

7. The cutting device of claim 1, wherein the cutting member is formed from Zirconium Oxide.

8. The cutting device of claim 1, further comprising a movable locking member that is received by portions of the first and second housing members, the movable locking member configured to move to selectively unlock and lock the first and second housing members together.

9. A cutting device, comprising:

a first housing member;

a second housing member that is removably attachable to the first housing member to form a housing;

a carriage that is movably disposed in the housing, the carriage including a first cavity, which is disposed at a first portion of the carriage, and a second cavity, which is disposed at a second portion of the carriage that is disposed away from the first portion of the carriage; and a cutting member that is removably disposable in the first cavity at the first portion of the carriage;

wherein the cutting member is removably disposable in the second cavity at the second portion of the carriage;

wherein the cutting member is a ceramic blade;

wherein the carriage includes a protrusion;

wherein at least one of the first housing member and the second housing member includes an aperture having a first aperture, a second aperture portion, a third aperture portion, and a fourth aperture portion wherein the third aperture portion and the fourth aperture portion are elongated grooves extending in a longitudinal direction of the cutting device, and the first aperture portion and the second aperture portion are elongated grooves extending in a transverse direction of the cutting device that is substantially perpendicular to the longitudinal direction of the cutting device; and wherein the protrusion is selectively receivable in the first aperture portion and in the second aperture portion.

10. The cutting device of claim 9, wherein the third aperture portion connects the first aperture portion and the second aperture portion, and the fourth aperture portion extends from the second aperture portion in a direction extending away from the first aperture portion.

11. The cutting device of claim 9, wherein when the protrusion is received in the first aperture portion then the carriage is locked in the retracted position, and when the protrusion is received in the second aperture portion then the carriage is locked in the extended position.

12. The cutting device of claim 9, wherein the protrusion is removable from the first and second aperture portions based on moving the protrusion toward an interior of the housing.

13. The cutting device of claim 9, further comprising a slidable locking member that is received by portions of the first and second housing members, the sliding locking member configured to slide to selectively unlock and lock the first and second housing members together.

14. A cutting device, comprising:

a first housing member;

a second housing member that is removably attachable to the first housing member to form a housing with a first and second blade outlet formed in a front edge portion of the housing;

a carriage that is movably disposed in the housing, the carriage formed with a first blade recess at a top edge of the carriage and a second blade recess at a bottom edge of the carriage;

an exterior member disposed at an exterior of the housing and attached to the carriage via an aperture disposed in one of the first housing member and the second housing member; and a cutting blade that is removably attachable to the first blade recess or the second blade recess, wherein each of the blade recesses is configured to receive a portion of a cutting blade and to orient a cutting edge of the cutting blade to be facing outward from a center portion of the carriage.

15. The cutting device of claim 14, wherein the front edge portion is a curve beginning at a top flat edge of the housing and terminating at bottom flat edge of the housing.

16. The cutting device of claim 15, wherein the first blade outlet is formed between the top flat edge of the housing and a middle point of the curve and the second blade outlet is formed between the bottom flat edge of the housing and the middle point of the curve.

17. The cutting device of claim 15, wherein each of the housing members is formed with a connector element at a midpoint of the curve.

18. The cutting device of claim 14, wherein the exterior member attaches to the carriage between the first and second blade recesses.

19. The cutting device of claim 14, wherein the first blade recess is open along the top edge of the carriage and the second blade recess is open along the bottom edge of the carriage.

20. The cutting device of claim 19, wherein the first blade recess holds the cutting blade such that the cutting blade is substantially parallel to the top edge of the carriage and the second blade recess holds the cutting blade such that the cutting edge is substantially parallel to the bottom edge of the carriage.

21. The cutting device of claim 14, wherein each blade recess is configured to orient the cutting edge of the cutting blade to face in an opposite direction relative to the other blade recess.

22. The cutting device of claim 14, wherein the first blade outlet is aligned to permit the cutting blade to be exposed when the blade carriage is in an extended position and the cutting blade is in the first blade recess and the second blade outlet is aligned to permit the cutting blade to be exposed when the blade carriage is in the extended position and the cutting blade is in the second blade recess.

* * * * *